US005176373A

United States Patent [19]

Namba

[11] Patent Number: 5,176,373

[45] Date of Patent: Jan. 5, 1993

[54] SHEET FEEDING UNIT INCORPORATING A CURL INDUCING MECHANISM

[75] Inventor: Toyoaki Namba, Nara, Japan

[73] Assignee: Sharp Kabushiki Kaisha, Osaka, Japan

[21] Appl. No.: 763,191

[22] Filed: Sep. 20, 1991

[30] Foreign Application Priority Data

Sep. 28, 1990 [JP] Japan ..... 2-264221

[51] Int. Cl.[5] ..... B65H 5/22

[52] U.S. Cl. ..... 271/3.1; 271/98; 271/105; 271/35; 271/272; 162/271

[58] Field of Search ..... 271/3.1, 98, 99, 105, 271/106, 35, 272; 162/271

[56] References Cited

U.S. PATENT DOCUMENTS 3,424,453 1/1969 Halbert ..... 271/35
4,418,905 12/1983 Garavuso .
4,627,718 12/1986 Wyer .
4,813,660 3/1989 Dodd et al. ..... 271/98
5,050,853 9/1991 LaVos et al. ..... 271/98

FOREIGN PATENT DOCUMENTS 57-212461 12/1982 Japan .

*Primary Examiner*—H. Grant Skaggs
*Attorney, Agent, or Firm*—David G. Conlin

[57] ABSTRACT

A sheet feeding apparatus for reconveying copy paper sheets carrying an image to a transfer section by suction. Along the transport path to the apparatus is arranged a curl inducing mechanism that induces curls in the copy paper sheets, whereby the copy paper sheets with upwardly curled edges are loaded in the apparatus. With this arrangement, the copy paper sheets are surely separated by injecting air, thereby preventing multi-feeds.

2 Claims, 9 Drawing Sheets 36
36a
36a
37
38
38
38

SHEET FEEDING UNIT INCORPORATING A CURL INDUCING MECHANISM

FIELD OF THE INVENTION

The present invention relates to a sheet feeding apparatus for use with electrophotographic printers such as copying machines employing electrostatic image transferring system and laser printers, that reconveys copy paper sheets printed on one side to a transfer section to produce duplex (double-sided) copies or composite copies.

BACKGROUND OF THE INVENTION

Conventionally, as illustrated in FIG. 6, an electrophotographic printer capable of producing duplex copies and composite copies normally comprises the following: a transfer section 34 incorporating a photoreceptor 32 and a transfer charger 33, where an image is transferred to a sheet of copy paper S; a fixing section 36 having a pair of upper and lower heat rollers 36*a*, where the transferred image is fixed onto the copy paper sheet S; and a circulating path along which the copy paper sheet S carrying the image developed at the transfer section 34 and the fixing section 36 is reconveyed to the transfer section 34 to produce duplex copy or composite copy.

The transfer section 34, fixing section 36, and a transport belt 35 are arranged along the circulating path. The transport belt 35 conveys sheets of copy paper S from the transfer section 34 to the fixing section 36. As shown in FIG. 7, the path further has a diverter 37 for controlling the feeding direction of the copy paper S, a sheet inverting mechanism 40 for inverting the copy paper S, a sheet feeding apparatus 43 for reconveying the copy paper S to the transfer section 34, and plural rollers including transport rollers 38 for delivering the copy paper S.

As illustrated in FIG. 8, the sheet inverting mechanism 40 comprises a diverter 41 and a pair of inversion rollers 42. The inversion rollers 42 feed out a conveyed sheet of copy paper S in a direction opposite to the direction in which it has travelled. At this time, the diverter 41 turns in the A direction, so the copy paper sheet is fed out in the direction of the sheet feeding apparatus 43. This mechanism ensures that sheets of copy paper S are conveyed to the sheet feeding apparatus 43 in an inverted state.

As shown in FIG. 9, the sheet feeding apparatus 43 comprises an intermediate tray 44 whereon a stack of copy paper sheets S are temporarily stored, and an injection duct 45 for injecting air between the copy paper sheets S. The intermediate tray 44 is composed of a sheet stacker 44*a* where the copy paper sheets S are loaded, a suction duct 44*b* for pulling a copy sheet S' which lays at the bottom of the copy paper sheets S on the sheet stacker 44*a*, and a sheet feed belt 44*c* which delivers the bottom copy sheet S' in the E direction, i.e. to the transfer section 34. Sheets of copy paper S stored on the sheet stacker 44*a* are separated by the flow of air from the injection duct 45, and simultaneously the bottom copy sheet S' of the copy paper S is drawn down onto the sheet feed belt 44*c* by the suction duct 44*b* and conveyed to the transfer section 34.

In a conventional arrangement, however, the copy paper sheets S carrying an image which has been fixed thereto by the heat rollers 36*a* at the fixing section 36 tend to curl up due to great heat. Also, the diverter 37 coercively controls the feeding direction, so that the copy paper sheets S have curls corresponding to the curve of the diverter 37.

As illustrated in FIG. 9, this arrangement makes the copy paper sheets S loaded on the sheet stacker 44*a* in the sheet feeding apparatus 43 have downwardly curled edges. The down-curls form a space between the copy paper sheets S and the sheet stacker 44*a* in the middle. Therefore, when reconveying the bottom copy sheet S', the curls inhibits the air from the injection duct 45 from flowing. As a result, sheets can not be sufficiently separated, causing multi-feeds.

SUMMARY OF THE INVENTION

An object of the present invention is to provide a sheet feeding apparatus which surely feeds one sheet of paper at a time.

In order to achieve the object, a sheet feeding unit of the present invention comprises a sheet feeding apparatus and means for inducing curls in copy paper sheets. The sheet feeding apparatus incorporates a loading plate where copy paper sheets having curled edges are loaded, air injection means for injecting air between the leading edges of the copy paper sheets on the loading plate from upper-front side of the leading edges, a suction duct, and a sheet feed belt. The suction duct, placed below the loading plate, makes a sheet of copy paper stick to the sheet feed belt by suction, and the sheet feed belt conveys the sheet. The copy paper sheets are curled by the curl inducing means so that the sheets have upwardly curled edges at the time they are loaded on the loading plate.

With this configuration, the copy paper sheets loaded on the loading plate always have upwardly curled edges which have been induced by the curl inducing means. Therefore, when separating the bottom copy sheet to be conveyed from the rest of the copy paper sheets on the loading plate by injecting air between the leading edges of the copy paper sheets with the air injection means, the curls of the bottom copy sheet are substantially straightened as the bottom copy sheet is drawn by the suction duct, while the rest of the copy paper sheets remain curled upwardly. This causes the air to be injected more easily between the bottom copy sheet and the rest of the copy paper sheets. In consequence, the bottom copy sheet can be surely separated from the rest, and thus only the bottom copy sheet is fed out.

This configuration prevents multi-feeds of copy paper sheets which are caused by insufficient separation of the copy paper sheets.

For a fuller understanding of the nature and advantages of the invention, reference should be made to the ensuing detailed description taken in conjunction with the accompanying drawings.

BRIEF DESCRIPTION OF THE DRAWINGS

FIG. 1 illustrates the schematic structure of an electrophotographic printer.

FIG. 2 illustrates the schematic structure of a curl inducing mechanism and a sheet feeding apparatus placed along a circulating path.

FIG. 3 is a front view illustrating a sheet inverting mechanism and the curl inducing mechanism. .

FIG. 4 is an explanatory view illustrating how air is injected between copy paper sheets having upwardly curled edges in the sheet feeding apparatus.

FIG. 5 is a perspective view illustrating the curl inducing mechanism.

FIG. 6 illustrates the schematic structure of an electrophotographic printer.

FIG. 7 illustrates the schematic structure of a sheet feeding apparatus placed along a circulating path.

FIG. 8 is a front view illustrating a sheet inverting mechanism.

FIG. 9 is an explanatory view illustrating how air is injected between copy paper sheets having downwardly curled edges in the sheet feeding apparatus.

DETAILED DESCRIPTION OF THE PREFERRED EMBODIMENTS

Referring to FIG. 1 to FIG. 5, the following will describe one embodiment of the present invention.

Figure 1:
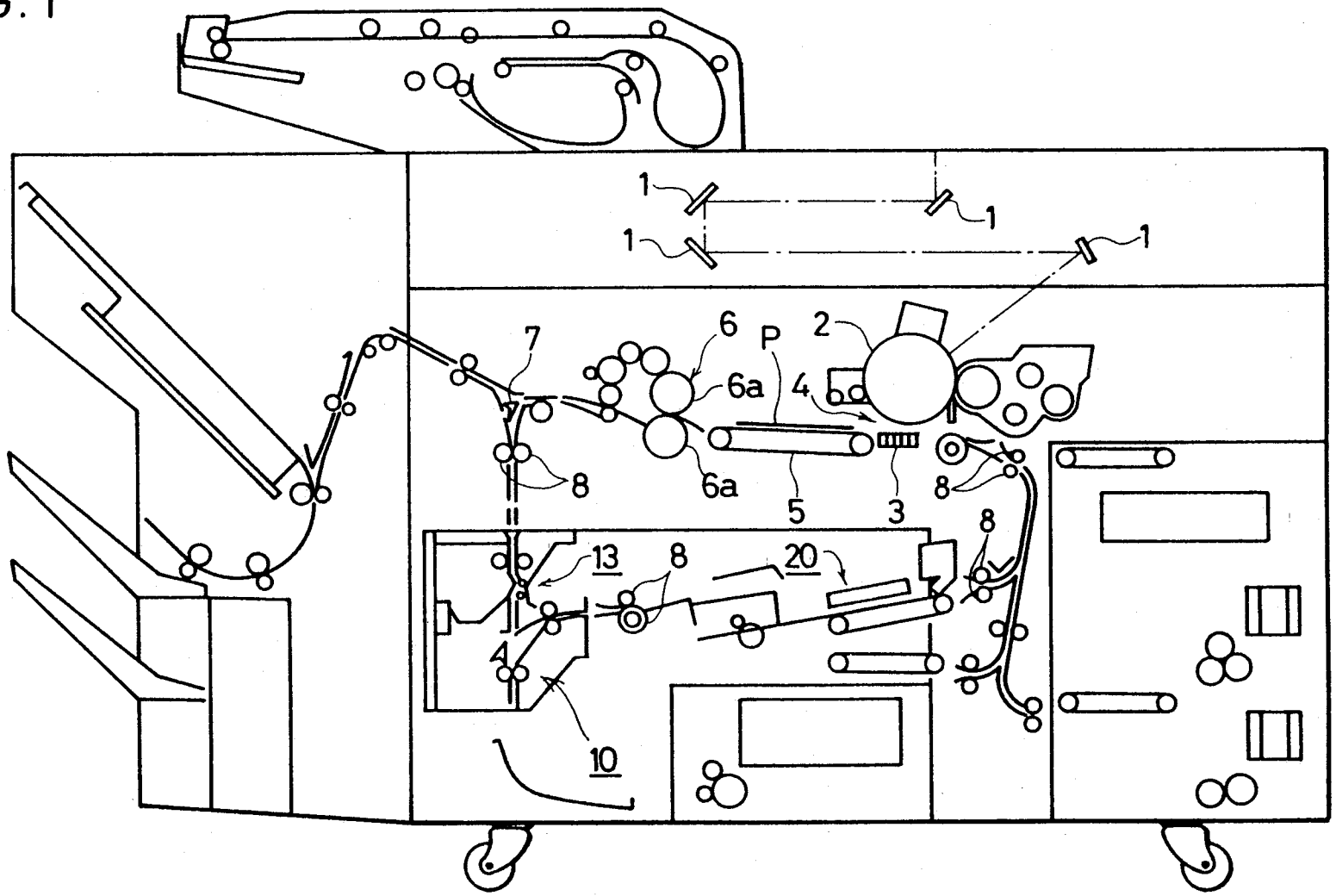
FIG. 1 to FIG. 5 illustrate one embodiment of the present invention.

As illustrated in FIG. 1, an electrophotographic printer comprises a transfer section 4 for transferring an image to copy paper sheets P, and a fixing section 6 for fixing the image transferred at the transfer section 4 onto the copy paper sheets P. The electrophotographic printer also has a transport belt 5, placed between the transfer section 4 and the fixing section 6, to convey the copy paper sheets P to the fixing section 6.

The transfer section 4 is composed of a photoreceptor 2 and a transfer charger 3 which is installed below the photoreceptor 2. At the photoreceptor 2, an electrostatic latent image exposed through an optical system 1 is developed into a visible image by bringing into contact with it toner particles. The transfer charger 3 transfers the image on the photoreceptor 2 to the copy paper sheets P.

The fixing section 6 has a pair of upper and lower heat rollers 6*a*. Here, the image transferred to the copy paper sheets P at the transfer section 4 is fixed thereto by the heat and pressure of the heat rollers 6*a*.

Also, the electrophotographic printer of this embodiment has a circulating path. The circulating path allows the copy paper P carrying the image developed at the transfer section 4 and the fixing section 6 to be reconveyed to the transfer section 4. This arrangement enables duplex copying, i.e. printing images on both sides the copy paper sheets P, and composite copying, i.e. printing a composite image on one side of the copy paper sheets P.

Figure 2:
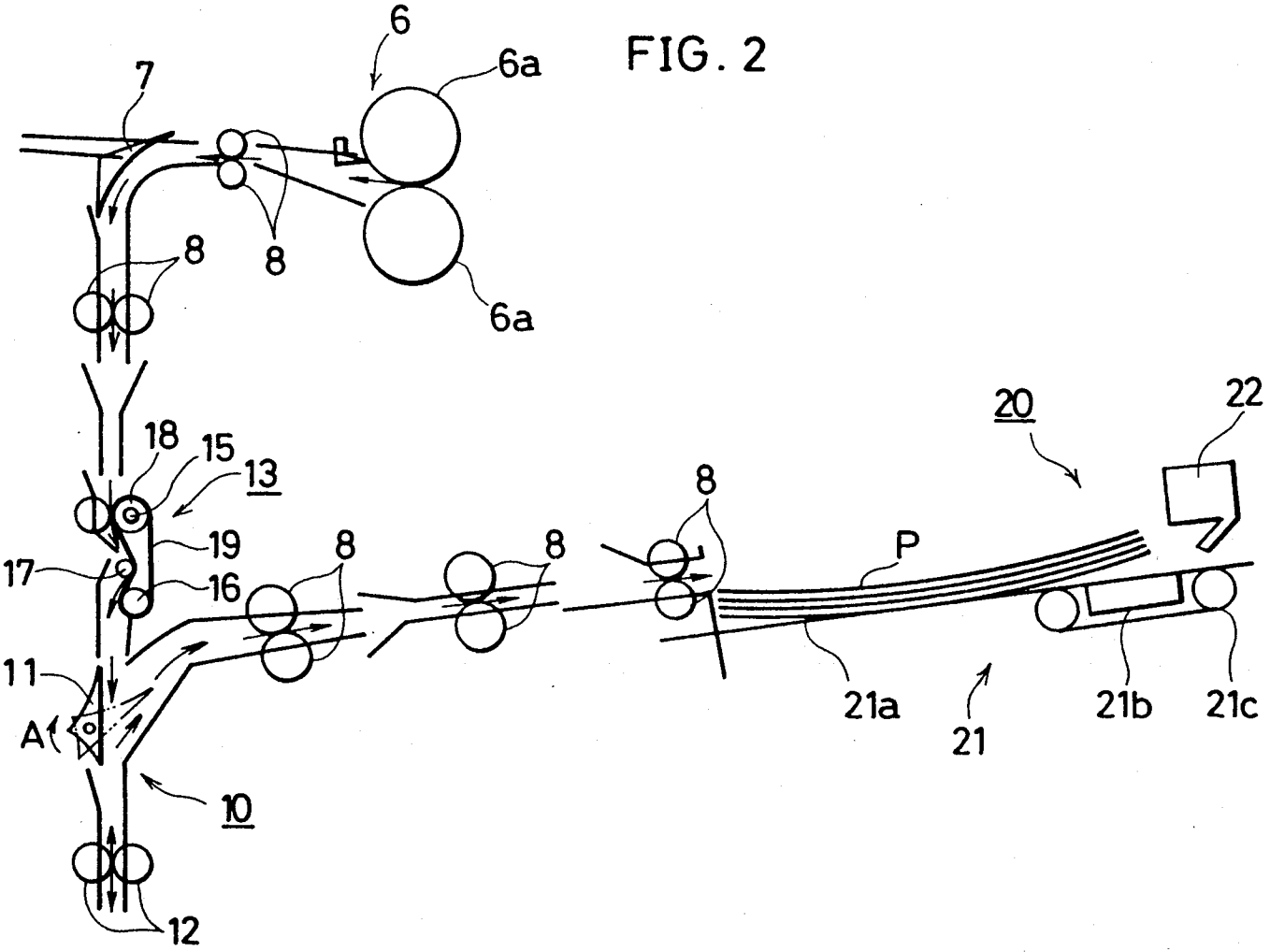

Along the circulating path are placed the transfer section 4, fixing section 6 and transport belt 5 as described above, a diverter 7 for controlling the feeding direction of the copy paper P, a sheet inverting mechanism 10 for inverting the copy paper P, a sheet feeding apparatus 20 for reconveying the copy paper P to the transfer section 4, and plural rollers including transport rollers 8 for delivering the copy paper P, as illustrated in FIG. 2.

A face of the diverter 7 which comes into contact with the copy paper P is curved so as to control the feeding direction of the copy paper P from a horizontal direction to a downward direction.

Figure 3:
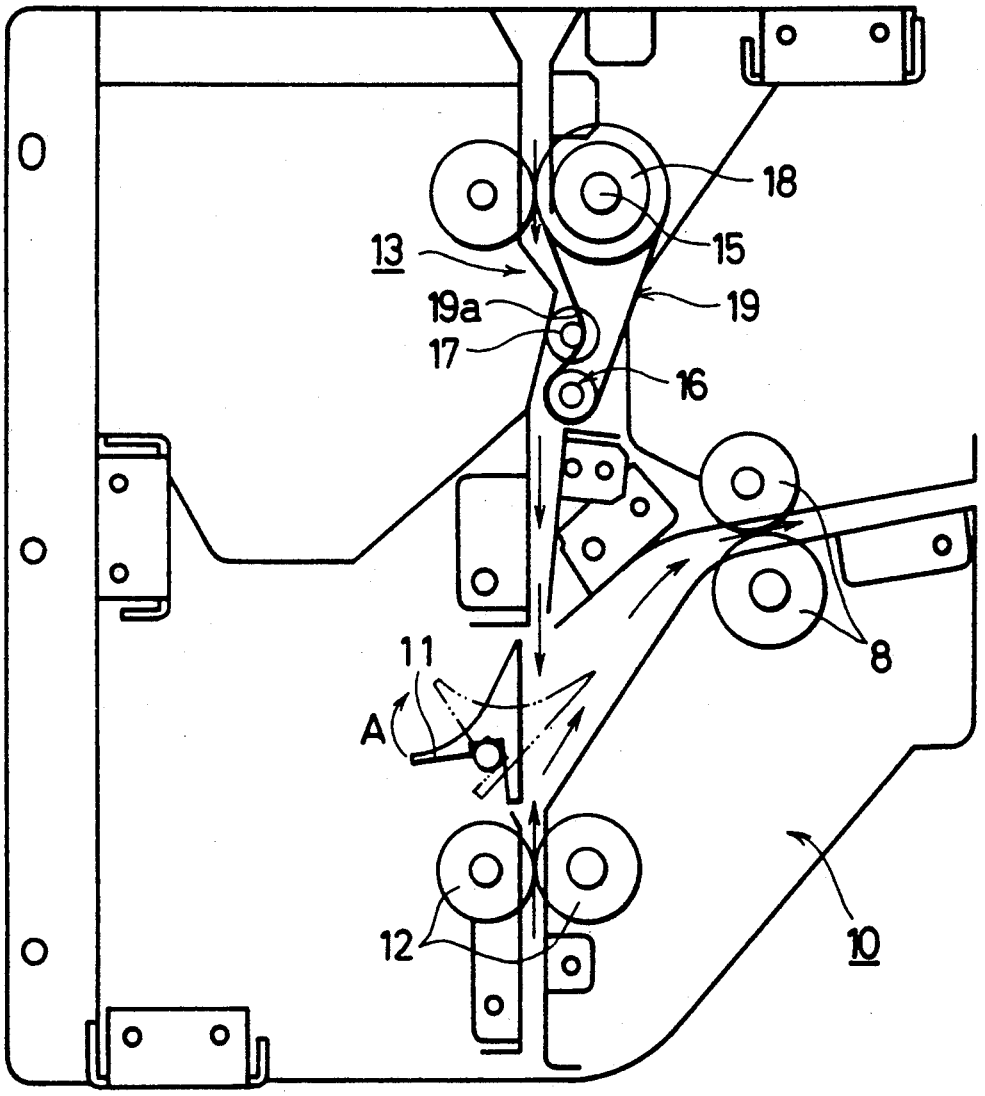

As illustrated in FIG. 3, the sheet inverting mechanism 10 comprises a diverter 11 and a pair of inversion rollers 12. A sheet of copy paper P conveyed is fed out in a direction opposite to the direction in which it has travelled by inverting the rotating direction of the inversion rollers 12 while nipping the copy paper sheet P between the rollers 12. Then, the diverter 11 turns in the A direction so as to control the feeding direction of the copy paper P towards the sheet feeding apparatus 20. As a result, the copy paper sheet P is conveyed to the sheet feeding apparatus 20 in an inverted state.

Figure 4:
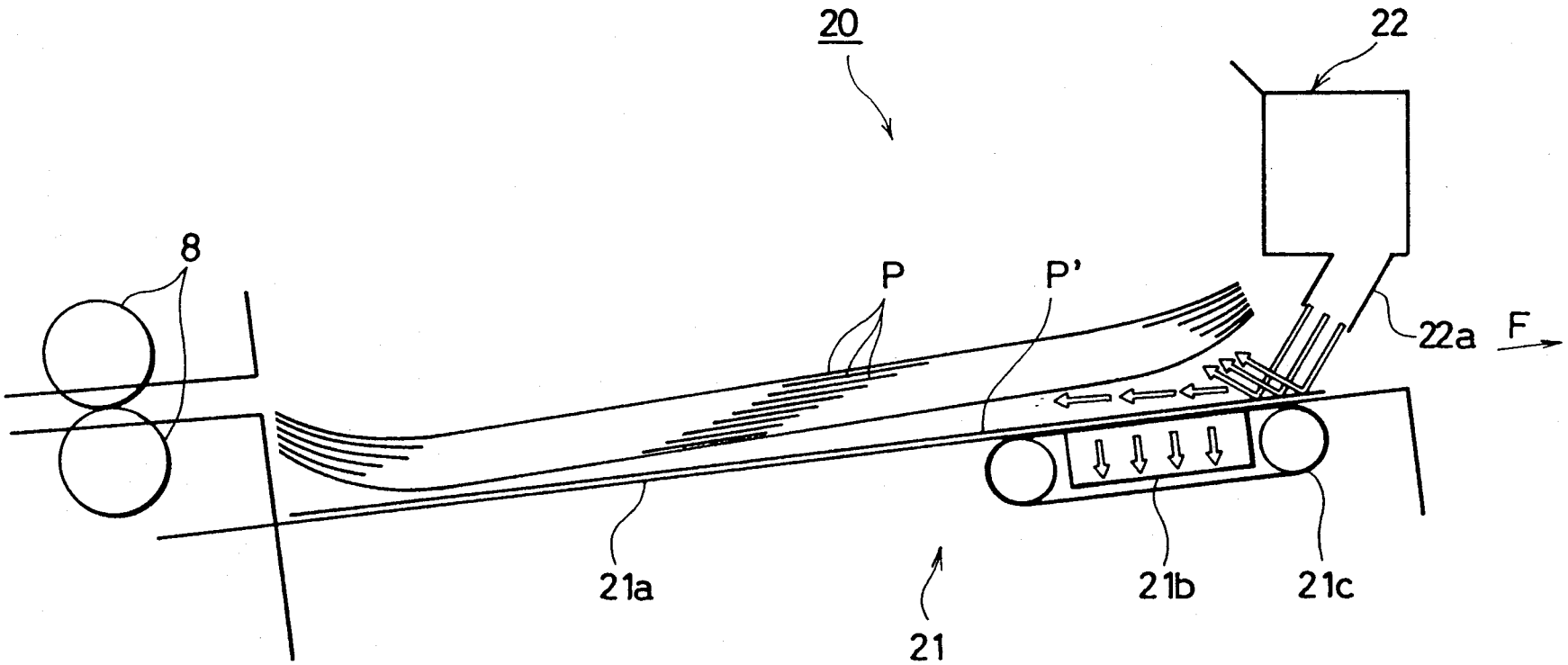

As illustrated in FIG. 4, the sheet feeding apparatus 20 comprises an intermediate tray 21 where sheets of copy paper P are temporarily loaded and an injection duct (air injection means) 22 for injecting air between the copy paper sheets P.

The intermediate tray 21 is composed of a sheet stacker 21*a* (loading plate) where the copy paper sheets P are loaded, a suction duct 21*b* for pulling a copy sheet P' which lays at the bottom of the copy paper sheets P on the sheet stacker 21*a*, and a sheet feed belt 21*c* for feeding out the bottom copy sheet P' in the F direction, i.e. to the transfer section 4. One end of the injection duct 22 is connected to a blower (not shown) and the other end has a nozzle 22*a* for injecting air supplied from the blower. The nozzle 22*a* is designed such that the air is injected between the leading edges of the copy paper sheets P in the feeding direction and such that the copy paper sheets P are separated by the air flow from the nozzle 22*a*.

Further, as illustrated in FIG. 3 the electrophotographic printer comprises curl inducing means, that is, a curl inducing mechanism 13 for straightening the curls of the copy paper sheets P, installed between the diverter 7 and the sheet inverting mechanism 10 along the circulating path.

Figure 5:
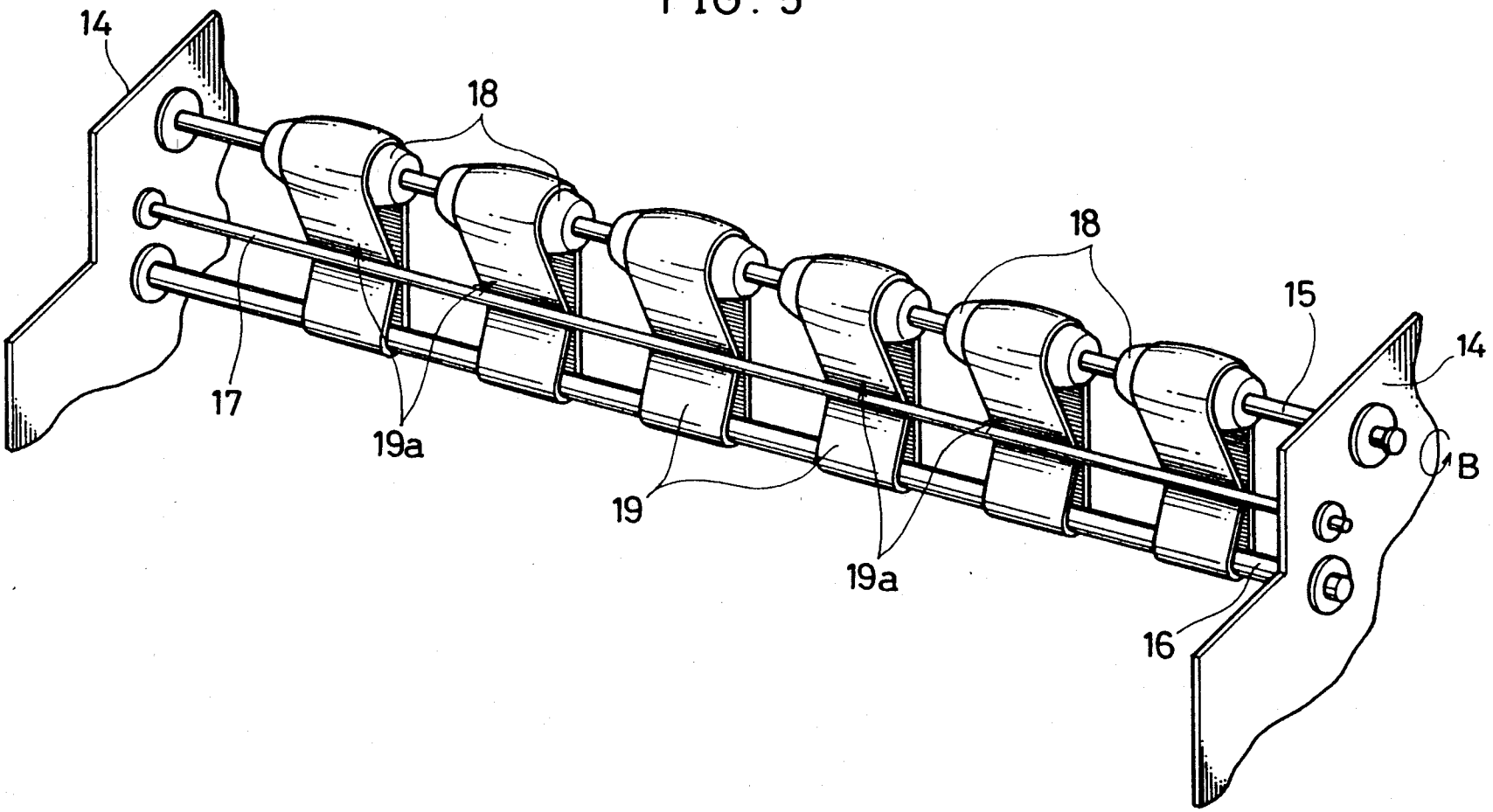
Figure 6:
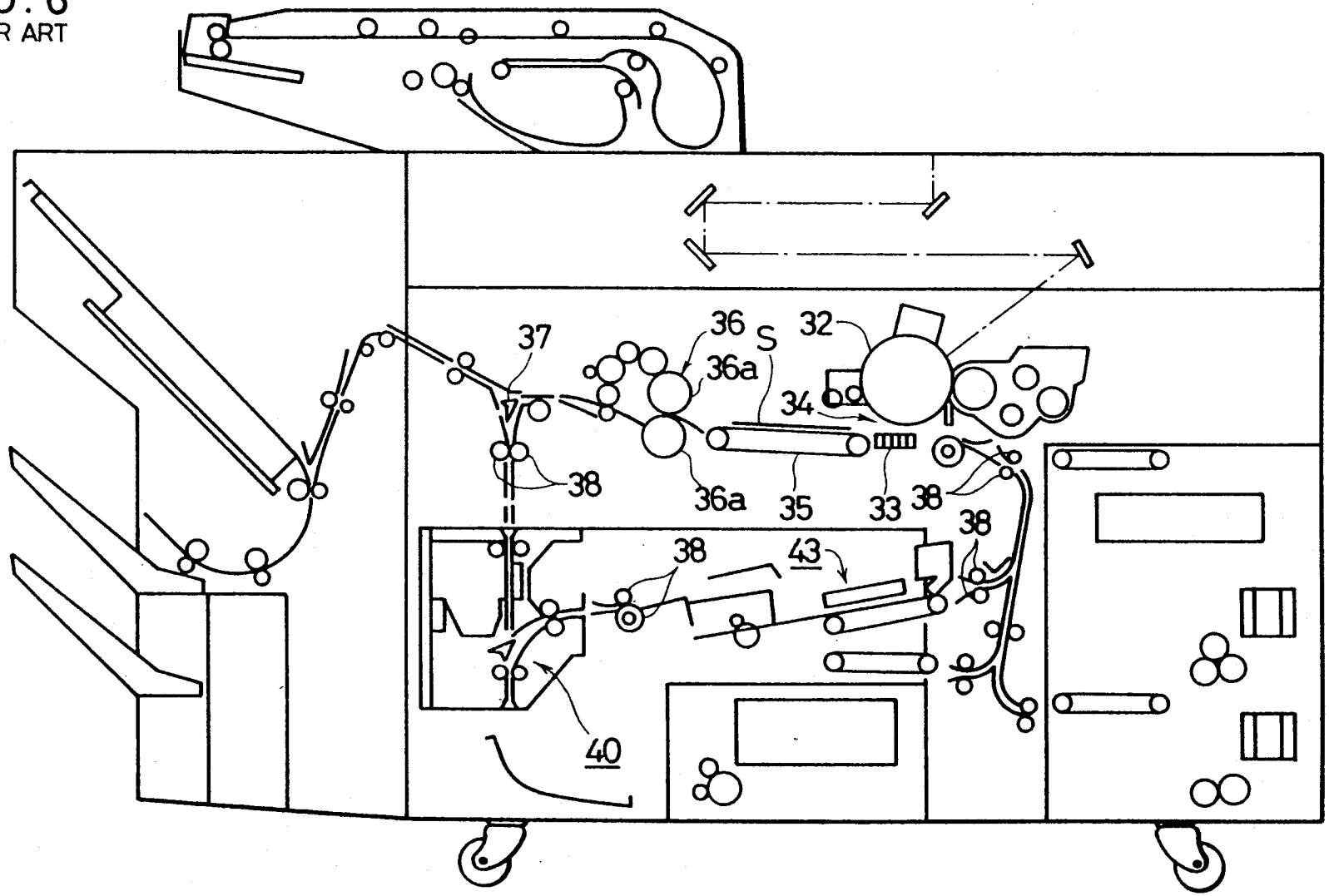
FIG. 6 PRIOR ART
FIG. 6 to FIG. 9 illustrate a conventional example.
Figure 7:
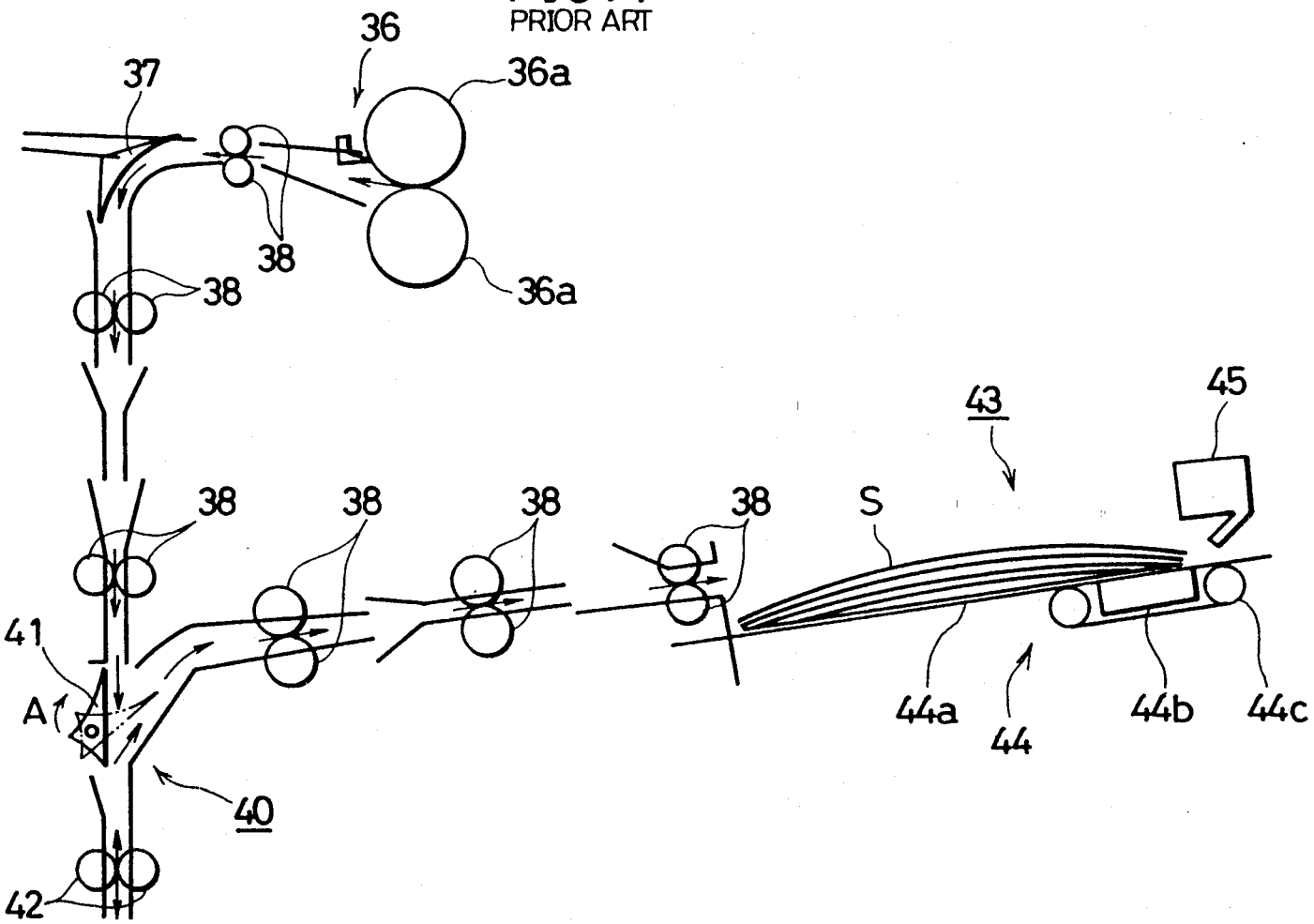
Figure 8:
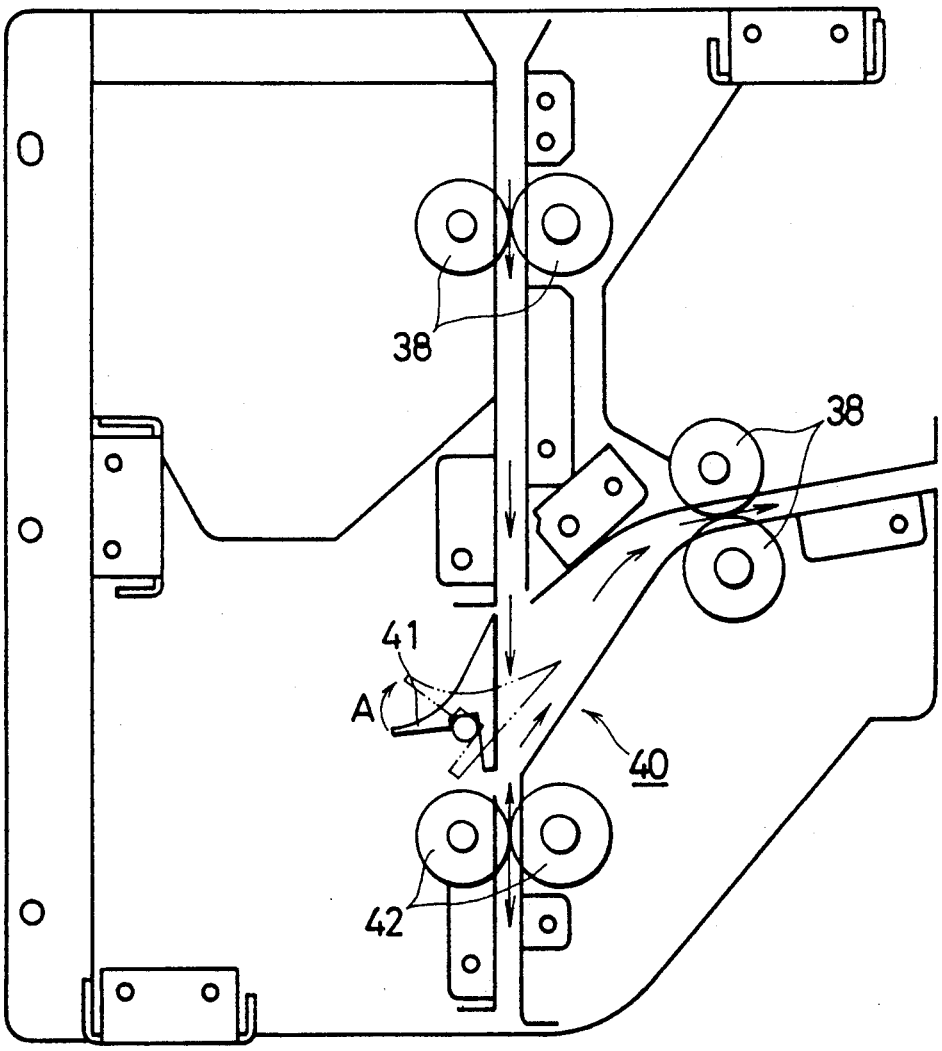
FIG. 8 PRIOR ART
Figure 9:
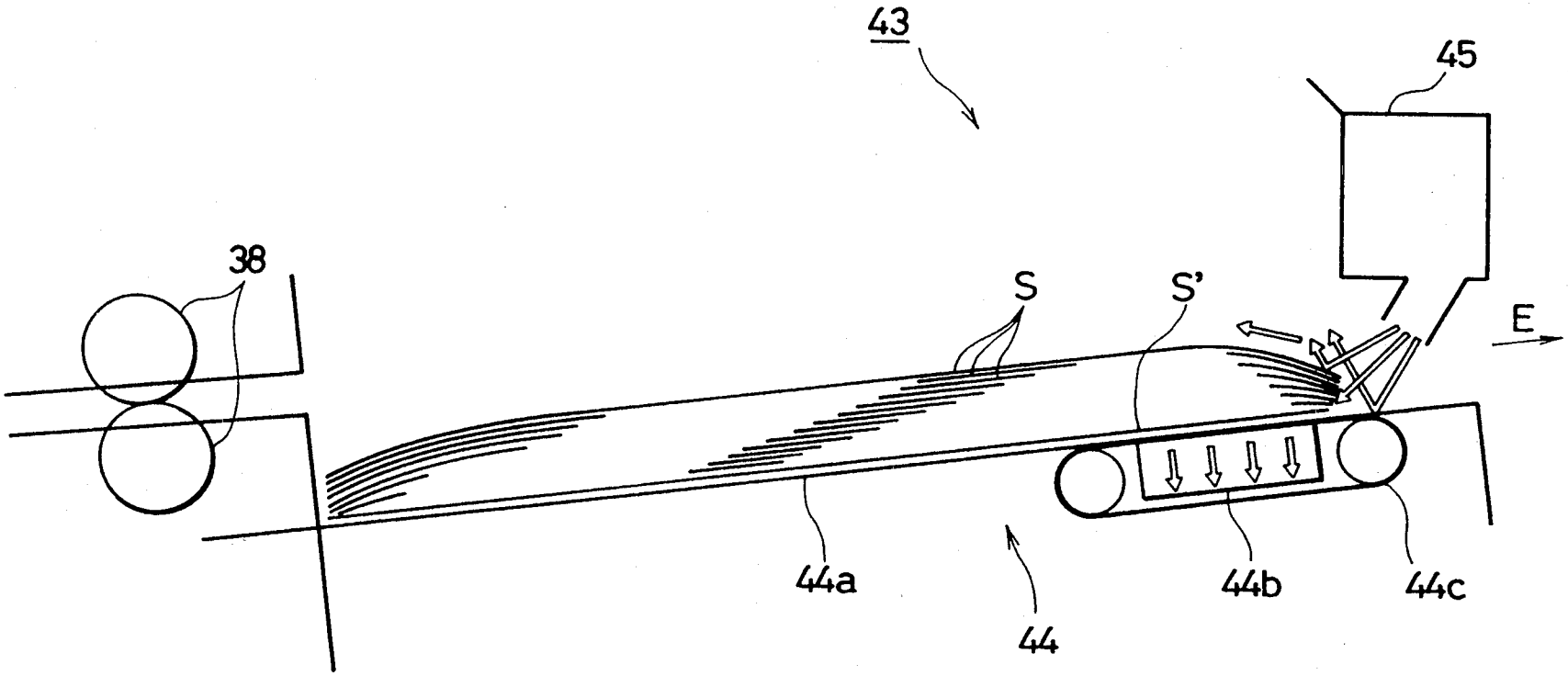
FIG. 9 PRIOR ART

As shown in FIG. 5, the curl inducing mechanism 13 is composed of a pair of support walls 14 which are placed opposite to each other with a given interval between them. Between the support walls 14, a driving shaft 15, a coupled driving shaft 16 and a belt pressing shaft 17 are installed so that each shaft can rotate freely. The driving shaft 15 is driven to rotate in the B direction by a driving motor (not shown). A plurality of rollers 18 in the shape of a barrel are fixed around the driving shaft 15 with a predetermined interval between rollers 18 along the axis direction. Belts 19, pressed by the belt pressing shaft 17, are arranged around the coupled driving shaft 16 and rollers 18 respectively while maintaining a predetermined tension.

As illustrated in FIG. 3, the radius of curvature of the belt pressing shaft 17 is smaller than that of the rollers 18 on the driving shaft 15, and portions 19*a* of the belts 19 pressed by the belt pressing shaft 17 are bent into a concave shape.

The curl inducing mechanism 13 is designed to induce curls in the copy paper sheets P in the same direction as that to which the bent portions 19*a* of the belts 19 are curved.

The following will discuss how the copy paper sheets P are conveyed from the fixing section 6 to the sheet feeding apparatus 20 along the circulating path in the above-described arrangement.

As shown in FIG. 2, a sheet of copy paper P, carrying an image which has been fixed thereto by the heat rollers 6*a* at the fixing section 6 is fed into the diverter 7 by the transport rollers 8. The feeding direction of the copy paper P is switched to a downward direction from a horizontal direction by the diverter 7, so the copy paper sheet P is delivered to the curl inducing mechanism 13.

Next, at the curl inducing mechanism 13, the copy paper sheet P is fed between the belts 19 and the belt pressing shaft 17, whereby the copy paper sheet P is curled in the same direction as the bent portions 19*a* of the belts 19 to which they are bent into a concave shape. Then, the copy paper sheet P is delivered to the sheet inverting mechanism 10.

The copy paper sheet P fed into the sheet inverting mechanism 10 passes through the side of the diverter 11 and is then nipped between the inversion rollers 12. When the rotating direction of the inversion rollers 12 is inverted, the copy paper sheet P is fed out into a direction opposite to the direction in which it has travelled. When the copy paper sheet P is fed out, the diverter 11 turns in the A direction, and therefore the copy paper sheet P is conveyed to the sheet feeding apparatus 20 in an inverted state.

The transport rollers 8 delivers the copy paper sheet P to the sheet feeding apparatus 20 in an inverted state. As shown in FIG. 4, the copy paper sheets P whose both edges have been upwardly curled are loaded on the sheet stacker 21*a*.

When sheets of copy paper P with upwardly curled edges are loaded on the sheet stacker 21*a*, the bottom sheet P' of the copy paper sheets P is pulled down onto the sheet feed belt 21*c* by the suction duct 21*b* and conveyed to the F direction. At this time, air is injected between the copy paper sheets P by means of the injection duct 22 so as to separate the bottom sheet P' from the rest of the copy paper sheets P. In consequence, only the bottom sheet P' is pulled down by the suction duct 21*b* and conveyed. The curled edges of the bottom sheet P' are substantially straightened as the bottom sheet P' is pulled down by the suction duct 21*b*, while the rest of the copy paper sheets P remain curled.

As described above, as the curl inducing mechanism 13 is arranged between the diverter 7 and the sheet inverting mechanism 10 along the circulating path, the copy paper sheets P with upwardly curled edges are loaded on the sheet stacker 21*a* of the sheet feeding apparatus 20 in this embodiment. This upward-curls enable successful separation of sheets of the copy paper P using the air flow from the injection duct 22.

The present invention is not restricted to the above embodiment, and therefore various modifications may be made within the scope of the present invention. For example, the curl inducing mechanism 13 is not restricted to be placed between the diverter 7 and the sheet inverting mechanism 10 along the circulating path. So it may be installed between the sheet inverting mechanism 10 and the sheet feeding apparatus 20 along the circulating path.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet feeding unit comprising:

curl inducing means for inducing curls in sheets of copy paper;

a loading plate whereon the curled copy paper sheets are loaded;

air injection means for injecting air between leading edges in a feeding direction of the copy paper sheets, said air injection means being placed in front of and above the leading edges of the copy paper sheets;

a sheet feed belt for conveying one copy paper sheet; and a suction duct for making one sheet of the copy paper stick to said sheet feed belt by suction, said suction duct being placed below said loading plate, wherein the curls are induced in the copy paper sheets so that the copy paper sheets loaded on said loading plate have upwardly curled edges, and wherein said curl inducing means comprises:

a rotatable driving shaft;

barrel-shaped rollers fixed around said driving shaft;

a coupled driving shaft mounted parallel to said driving shaft;

belts arranged around said rollers and said coupled driving shaft; and a belt pressing shaft mounted parallel to said driving shaft, and having a radius of curvature that is smaller than that of said rollers, wherein bent portions of said belts pressed by said belt pressing shaft are bent into a concave shape, and the copy paper sheets are fed between said belt pressing shaft and the bent portions.

2. A method for feeding copy paper sheets comprising the steps of:

inducing curls in copy paper sheets;

loading the copy paper sheets having upwardly curled edges successively on a loading plate;

injecting air between the edges of the loaded copy paper sheets for separation; and drawing a bottom sheet of the copy paper sheets by suction to be fed out, wherein said curl inducing means comprises:

a rotatable driving shaft;

barrel-shaped rollers fixed around said driving shaft;

a coupled driving shaft mounted parallel to said driving shaft;

belts arranged around said rollers and said coupled driving shaft; and a belt pressing shaft mounted parallel to said driving shaft and having a radius of curvature that is smaller than that of said rollers, wherein bent portions of said belts pressed by said belt pressing shaft is bent into a concave shape, and the copy paper sheets are fed between said belt pressing shaft and the bent portions.

* * * * *